US009005378B2

(12) United States Patent
Kochi et al.

(10) Patent No.: US 9,005,378 B2
(45) Date of Patent: Apr. 14, 2015

(54) SPRING STEEL WIRE ROD EXCELLENT IN DECARBURIZATION RESISTANCE AND WIRE DRAWING WORKABILITY AND METHOD FOR PRODUCING SAME

(75) Inventors: Takuya Kochi, Kobe (JP); Shogo Murakami, Kobe (JP); Takeshi Kuroda, Kakogawa (JP); Hiromichi Tsuchiya, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 1362 days.

(21) Appl. No.: 12/192,437

(22) Filed: Aug. 15, 2008

(65) Prior Publication Data

US 2009/0065105 A1 Mar. 12, 2009

(30) Foreign Application Priority Data

Sep. 10, 2007 (JP) ..... 2007-234564

(51) Int. Cl.
*C22C 38/18* (2006.01)

(52) U.S. Cl.
CPC ..... *C22C 38/18* (2013.01)

(58) Field of Classification Search
USPC ..... 148/580, 333
See application file for complete search history.

(56) References Cited

U.S. PATENT DOCUMENTS

| | | | | |
|---|---|---|---|---|
| 4,533,401 | A * | 8/1985 | Yutori et al. | 148/598 |
| 7,037,387 | B2 | 5/2006 | Nagao et al. | |
| 7,618,498 | B2 * | 11/2009 | Kochi et al. | 148/328 |
| 2003/0079815 | A1 * | 5/2003 | Hata et al. | 148/598 |
| 2006/0048864 | A1 | 3/2006 | Nagao et al. | |
| 2006/0130946 | A1 | 6/2006 | Minamida et al. | |
| 2006/0196584 | A1 | 9/2006 | Kochi et al. | |
| 2007/0125456 | A1 | 6/2007 | Kochi et al. | |
| 2007/0277913 | A1 | 12/2007 | Kochi et al. | |
| 2008/0156403 | A1 | 7/2008 | Masuda et al. | |

FOREIGN PATENT DOCUMENTS

| | | |
|---|---|---|
| JP | 2002-194432 | 7/2002 |
| JP | 2003-105496 | 4/2003 |
| JP | 2003-253391 | 9/2003 |
| JP | 2003-268433 | 9/2003 |
| JP | 2004-10965 | 1/2004 |
| JP | 2006-342400 | 12/2006 |
| JP | 2007-009300 | 1/2007 |
| WO | WO 2007/099671 A1 | 9/2007 |

OTHER PUBLICATIONS

U.S. Appl. No. 12/466,865, filed May 15, 2009, Kochi, et al.
U.S. Appl. No. 12/063,324, filed Feb. 8, 2008, Takeshi Kuroda et al.
U.S. Appl. No. 12/160,913, filed Jul. 15, 2008, Takuya Kochi.
Office Action issued Dec. 20, 2011, in Japanese Patent Application No. 2007-234564, filed Sep. 10, 2007 (with English-language Translation).

* cited by examiner

*Primary Examiner* — Jessee Roe
*Assistant Examiner* — Christopher Kessler
(74) *Attorney, Agent, or Firm* — Oblon, McClelland, Maier & Neustadt, L.L.P.

(57) ABSTRACT

Disclosed is a spring steel wire rod that comprises C in a range of 0.35 to 0.65% (mass %, the same applies to respective elements described hereinafter), Si in a range of 1.4 to 2.2%, Mn in a range of 0.10 to 1.0%, Cr in a range of 0.1 to 2.0%, P not more than 0.025% (0% excluded), and S not more than 0.025% (0% excluded), balance comprising iron, and unavoidable impurities, wherein an average grain size Dc of a central part of the steel wire rod is not more than 80 μm while an average grain size Ds of a surface layer part of the steel wire rod is not less than 3.0 μm.

18 Claims, No Drawings

SPRING STEEL WIRE ROD EXCELLENT IN DECARBURIZATION RESISTANCE AND WIRE DRAWING WORKABILITY AND METHOD FOR PRODUCING SAME

BACKGROUND OF THE INVENTION

The invention relates to a spring steel wire rod, and a method for producing the same, and more particularly, to a spring steel wire rod excellent in decarburization resistance, and satisfactory in wire drawing workability without undergoing ferritic decarburization otherwise occurring in a hot-rolling process, and a quenching process, and a method for producing the same.

A spring steel wire rod for use in production of a suspension spring, and so forth is normally produced by the steps of heating a billet, hot rolling the billet to be reduced to a wire rod of a predetermined wire diameter, subsequently winding the same in the form of a wound wire coil to be then cooled. The spring steel wire rod produced as above is thereafter subjected to processes of wire drawing→quenching and tempering→setting→shot peening to be subsequently turned into a spring.

Characteristics required of the spring include inhibition of decarburization (ferritic decarburization). The ferritic decarburization is a phenomenon accompanying transformation of austenite to ferrite, and occurs due to surface decarburization of a spring steel wire rod in the process of tempering besides the hot rolling process. Since the inhibition of the ferritic decarburization brings about various advantages such as omission of a peeling process for cutting away a decarburized layer, and so forth, yield enhancement, and so forth, besides ensuring of spring fatigue characteristics, there have since been made various proposals for inhibiting the ferritic decarburization. Technologies for inhibiting occurrence of a ferritic decarburized layer have been proposed by, for example, controlling composition of steel as disclosed in Patent Documents 1 and 2, or controlling heating temperature at the time of hot rolling, a cooling rate after the rolling, and so forth as disclosed in Patent Documents 3, and 4.

Further, excellence in wire drawing workability is required of a spring. For the spring steel wire rod, use is normally made of steel containing carbon in amounts in a range of about 0.35 to 0.65% from the viewpoint of ensuring strength, and so forth, so that there often occurs an increase in hardness after hot rolling, resulting in occurrence of a break in wire, and a crack at the time of wire drawing applied later on. Accordingly, various technologies for implementing enhancement of wire drawing workability of the spring steel wire rod have been proposed, and for example, in Patent Document 5, there has been described a method for improving the characteristics described as above by controlling composition of steel.

However, there has not been developed as yet a technology whereby the inhibition of the ferritic decarburization is rendered compatible with the enhancement of the wire drawing workability.

Patent Document 1: JP-A No. 2004-10965
Patent Document 2: JP-A No. 2003-105496
Patent Document 3: JP-A No. 2003-268433
Patent Document 4: JP-A No. 2002-194432
Patent Document 5: JP-A No. 2003-253391

SUMMARY OF THE INVENTION

It is an object of the invention to provide a spring steel wire rod excellent in decarburization resistance during hot-rolling process, and quenching process, and satisfactory in wire drawing workability as well even by use of steel with composition commonly adopted for production of a spring without application of a particular composition design, and a method for producing the same.

In accordance with one aspect of the invention, there is provided a spring steel wire rod that has achieved the object described as above, the spring steel wire rod comprising C in a range of 0.35 to 0.65% (mass %, the same applies to respective elements described hereinafter), Si in a range of 1.4 to 2.2%, Mn in a range of 0.10 to 1.0%, Cr in a range of 0.1 to 2.0%, P not more than 0.025% (0% excluded), and S not more than 0.025% (0% excluded), balance comprising iron, and unavoidable impurities, wherein an average grain size Dc of a central part of the steel wire rod is not more than 80 μm and an average grain size Ds of a surface layer part of the steel wire rod is not less than 3.0 μm.

Further, another spring steel wire rod that has achieved the objet described as above preferably comprises C in a range of 0.35 to 0.49% (mass %, the same applies to respective elements described hereinafter) Si in a range of 1.4 to 2.1%, Mn in a range of 0.10 to 1.0%, Cr in a range of 0.1 to 2.0%, P not more than 0.025% (0% excluded), and S not more than 0.025% (0% excluded), balance comprising iron, and unavoidable impurities.

The spring steel wire rod preferably further comprises Ti in a range of 0.01%-0.10%, V in a range of 0.12%-0.30%, Ni in a range of 0.2-0.7%, and Cu not more than 1% (0% excluded).

The spring steel wire rod described as above may further comprise Mo not more than 1% (0% excluded).

The spring steel wire rod described as above may still further comprise at least one element selected from the group consisting of Nb not more than 0.1% (0% excluded), and Zr not more than 0.1% (0% excluded).

In accordance with another aspect of the invention, there is provided a spring obtained by use of any of the spring steel wire rods described as above.

Further, the invention provides in its still another aspect a method of producing the spring steel wire rod that has achieved the objet described as above, the method comprising the step of heating steel comprising C in a range of 0.35 to 0.65%, Si in a range of 1.4 to 2.2%, Mn in a range of 0.10 to 1.0%, Cr in a range of 0.1 to 2.0%, P not more than 0.025% (0% excluded), and S not more than 0.025% (0% excluded), balance comprising iron, and unavoidable impurities, to a temperature (T1) not lower than 1110° C. at an average warming rate (HR1) not less than 15° C./min, and hot rolling the steel at a rolling temperature (T2) not lower than 850° C., and a finish-rolling temperature (T3) in a range of 900 to 1150° C. to be subsequently wound at a winding temperature (T4) in a range of 880 to 1050° C., and the step of cooling the steel after reaching the winding temperature (T4) at an average cooling rate (CR1) not less than 1.5° C./sec in a range of the winding temperature (T4) to 720° C., and at an average cooling rate (CR2) not more than 2° C./sec in a range of 720 to 600° C. such that cooling is executed at an average cooling rate (CR3) not more than 0.3° C./sec in a range of the winding temperature (T4) to 500° C.

Thus, the invention can provide a spring steel wire rod excellent in the wire drawing workability without undergoing decarburization otherwise occurring after hot rolling. Further, a spring without occurrence of decarburization, after quenching, can be obtained by use of the spring steel wire rod according to the invention.

DETAILED DESCRIPTION OF THE PREFERRED EMBODIMENTS

The inventor has continued strenuous examinations to obtain a spring steel wire rod excellent in both decarburization resistance, and wire drawing workability even by use of steel of composition commonly adopted for production of a spring without application of a particular composition design.

As a result, the following has been found out, and the invention has been completed:

(a) An intended object can be attained by rendering an average grain size Ds of a surface layer part of a spring steel wire rod as large as possible, (specifically, Ds≥3.0 μm) in order to inhibit the ferritic decarburization not only in the hot rolling process but also in the quenching process, and by rendering an average grain size Dc of a central part of the spring steel wire rod as small as possible (specifically, Dc≤80 μm) in order to effectively prevent the break, and so forth, at the time of wire drawing, and (b) The spring steel wire rod described as above can be obtained by adequately controlling hot rolling conditions, and cooling conditions after the hot rolling, as described later in the present description.

In the present specification, "excellent in decarburization resistance" means the case where when observation is made on whether or not the ferritic decarburization is present after hot rolling, and quenching, according to a method described with reference to working examples to be described later on, respectively, occurrence of ferritic decarburization is not seen in either case.

Further, in the present specification, "excellent in wire drawing workability" means the case where no break in wire occurs when a hot rolled rod is subjected to wire drawing according to the method described with reference to the working examples to be described later on.

First, there is described hereinafter the average grain size (Ds, Dc) of a bcc-Fe crystal grain of a metallic structure, as the feature of a spring steel wire rod (hereinafter referred to also merely as "a steel wire rod") according to the invention.

First, the average grain size Ds of the surface layer part of the wire rod is set to not less than 3.0 μm. With the invention, it is of particular importance for inhibition of the ferritic decarburization to control Ds, and in order to effectively inhibit occurrence of decarburization not only in the hot rolling process but also in the quenching process, the lower limit of Ds is set to 3.0 μm (refer to the working examples to be described later on). The larger Ds is, the better, and Ds is preferably, at, for example, not less than 5 μm, more preferably at not less than 7 μm, and still more preferably at not less than 10 μm. There is no particular limitation to the upper limit of Ds from the viewpoint of the inhibition of the ferritic decarburization, however, the upper limit of Ds is preferably at about 20 μm in consideration of ductility and fatigue characteristics after quenching and tempering, notch sensitivity, and so forth. The upper limit of Ds is preferably 15 μm.

Now, upon implementation of the inhibition of the ferritic decarburization, the inventor has focused attention particularly on the average grain size Ds of the surface layer part for the reason that control of a structure of the surface layer is important because the ferritic decarburization occurs to the surface layer of a steel wire rod. This point is described in more detail hereinafter.

As described in the foregoing, it is pointed out in the invention that a problem to be solved is not only prevention of the ferritic decarburization occurring to a hot-rolled steel wire rod (after hot rolling, and before quenching treatment) but also prevention of occurrence of the ferritic decarburization in the quenching process. As shown with reference to the working examples to be described later on, even if the ferritic decarburization does not occur to the hot-rolled steel wire rod, there can be a case where the ferritic decarburization occurs in the quenching process applied thereafter, and it is deemed that this is because when the hot-rolled steel wire rod passes through a two-phase region of ferrite (α) and austenite (γ), the hot-rolled steel wire rod is held in the two-phase region for a long time. Therefore, the inventor has decided to set the average grain size Ds of the surface layer part where the ferritic decarburization occurs to a large (coarse) size under a conception that (a) if transformation from a two-phase region of ferrite (α) and cementite (θ), before heating, to the two-phase region of (α+γ) after heating, that is, reverse transformation to austenite (γ reverse transformation) is controlled when a warming rate at the time of heating in the quenching process is constant, holding time in the two-phase region of (α+γ) can be shortened, and (b) because the more fine a structure prior to transformation is, the more prone to occur is transformation nucleation, if the structure prior to transformation is rendered coarser, this will inhibit the γ reverse transformation, so that the ferritic decarburization can be prevented.

The Average Grain Size Dc of the Central Part of the Steel Wire Rod, Dc≤80 μm)

Next, the average grain size Dc of the central part of the steel wire rod is set to not more than 80 μm. With the invention, it is of particular importance for enhancement in wire drawing workability to control Dc, and accordingly, the upper limit of Dc is set to 80 μm (refer to the working examples to be described later on). The smaller Dc is, the better, and Dc is preferably, at, for example, not more than 60 μm, more preferably at not more than 40 μm, and still more preferably at not less than 30 μm. There is no particular limitation to the lower limit of Dc from the viewpoint of enhancement in the wire drawing workability, however, the lower limit of Dc is preferably about 15 μm in consideration of hardenability and so forth, at the time of quenching. A preferable lower limit of Dc is 20 μm.

Now, upon implementation of the enhancement in the wire drawing workability, the inventor has focused attention on the average grain size Dc of the central part for the reason that control of a structure of the central part is important because processing strain converges at the central part of the steel wire rod at the time of wire drawing, thereby rendering the central part prone to have a break in wire. As conventional means for enhancement in the wire drawing workability, widespread use has been made of a method whereby generation of supercooled structures, such as, for example, bainite, martensite, and so forth, are lessened to thereby control a structure to become a ferrite-pearlite structure, and a ferrite-cementite structure, however, even if the supercooled structures poor in the wire drawing workability are lessened, there is still a possibility that a break in wire will occur (refer to the working examples to be described later on), and particularly, in the case of a structure where the processing strain is prone to accumulation, there exists the possibility of occurrence of deterioration in ductility after processing, leading to a break in wire at the time of wire drawing. With the invention, Dc is controlled to a small (microscopic) size under an idea that the coarser a structure at the central part is, the more pronounced will be accumulation of the processing strain described as above.

Thus, with the spring steel wire rod according to the invention, a surface layer structure of the steel wire rod is controlled to a size as coarse as possible, and a central structure of the steel wire rod is controlled to a size as fine as possible, thereby inhibiting decarburization at the time of hot rolling and quenching, and preventing breaks in wire during the process of wire drawing. With reference to Ds and Dc, described as above, there is no particular limitation to, for example, a relationship between Ds and Dc. Accordingly, the relationship may be Ds>Dc, Ds<Dc, or Ds may be substantially equal to Dc provided that requirements described as above are satisfied. However, in consideration of tenacity after quenching and tempering, and hardenability after quenching, the relationship to satisfy Ds<Dc is preferably adopted.

Herein, by "a central part" is meant a part corresponding to the center (D/2) of a wire diameter (D) when a specimen for measurement of a grain size is prepared by a method described hereinafter. Further, by "a surface layer part" is meant a part in a range of about 50 to 150 μm in depth from the topmost surface of the specimen when the specimen for measurement of the grain size is prepared by the same method described as above.

The average grain sizes Dc, Ds of the steel wire rod, respectively, were measured in the following manner, using the SEM/EBSP (Electron Back Scatter diffraction Pattern) method.

First, a sample 10 mm long is taken from a hot rolled wire rod by a wet cutting, and subsequently, the sample is subjected to wet polishing, buffing, and chemical polishing, thereby preparing a specimen for EBSP measurement, the specimen with strains and asperities, due to polishing works, reduced as much as possible. In this case, the polishing works are applied such that observation faces of the specimen will correspond to the central part of the cross-section of the wire rod, and the surface layer part thereof, respectively. Measurements, using the specimen obtained, are made such that EBSP measurement positions will correspond to the central part of the wire diameter of a wire rod, and the surface layer part thereof, respectively. At this point in time, it is set such that a measurement step is by not more than 0.5 μm, and each of measurement areas of the wire rod is not less than 60,000 $\mu m^2$. After the measurements, analyses of crystal orientations are carried out, and in order to enhance reliability of the analyses, the analyses are made by use of results of the measurements, having an average CI (Confidence Index) not less than 0.3.

A region surrounded by boundary lines not less than 15° in difference between bearing angles, found by an analysis of crystal orientation of bcc-Fe, is defined as "a grain", having thereby obtained an analysis result (a boundary map). On the basis of the boundary map as obtained, areas of individual regions (crystal units) surrounded by the boundary lines, respectively, are found with the use of image analysis software [Image-Pro] (developed by Advansoft Co. Ltd.), and equivalent circle diameters (respective diameters of circles) as individual grain sizes are computed from the areas described as above. The measurements described are made on not less than 3 pieces of the specimens, thereby working out the average grain sizes of the central part, and the surface layer part, respectively, (Dc, Ds).

Next, there is described hereinafter chemical composition of the steel wire rod according to the invention. There is no particular limitation to composition of steel, and composition commonly used in spring steel can be adopted. Use can be made of spring steels described hereunder, as typical examples, and a spring excellent in spring characteristics can be obtained by so doing.

[C: 0.35-0.65%]

C is an element affecting strength of the steel wire rod, and the higher C content is, the higher is the strength obtained. For application of the steel wire rod according to the invention to a high-strength suspension spring, and so forth, the C content not lower than 0.35% is required. A preferable lower limit of the C content is 0.40%. However, if the C content is excessively high, this will cause deterioration in corrosion resistance, and the upper limit thereof is therefore set to 0.65%. A preferable upper limit thereof is 0.60%, and a more preferable upper limit thereof is 0.49%.

[Si: 1.4-2.2%]

Si is an element effective for enhancement in settling resistance requited of a spring, and for application of the steel wire rod according to the invention to the high-strength suspension spring, and so forth, Si content not lower than 1.4% is required. A preferable lower limit of the Si content is 1.6%, and a more preferable lower limit thereof is not lower than 1.8%. However, if the Si content is excessively high, this will inhibit precipitation of cementite at the time of quenching to subsequently increase residual austenite, thereby causing deterioration in spring characteristics, and the upper limit thereof is therefore set to 2.2%. A preferable upper limit of the Si content is 2.1%.

[Mn: 0.10-1.0%]

Mn is a useful element for locking S as an element causing deterioration in tenacity, in the form of MnS, to thereby render S harmless, and in order to allow such a useful effect of Mn to be fully exhibited, Mn content is set to not less than 0.10%. A preferable lower limit of the Mn content is 0.15%, and a more preferable lower limit thereof is not lower than 0.2%. However, if the Mn content is excessively high, this will cause solidification and segregation at the time of casting to become pronounced in degree, so that segregation zones will be prone to breakage, and the upper limit of the Mn content is therefore set to 1.0%. A preferable upper limit of the Mn content is 0.85%, and a more preferable upper limit of the Mn content is not more than 0.75%.

[Cr: 0.1-2.0%]

Cr is an element contributing to enhancement in corrosion resistance, and advantageous actions described as above are effectively exhibited by addition of Cr in amounts not less than 0.1%. A preferable lower limit of Cr content is 0.15%, and a more preferable lower limit thereof is not less than 0.2%. However, if the Cr content is excessively high, this will cause generation of coarse Cr-based carbides, causing deterioration in tenacity, and the upper limit of the Cr content is therefore set to 2.0%. A preferable upper limit of Cr content is 1.8%, and a more preferable upper limit thereof is not more than 1.6%.

[P: not more than 0.025% (0% excluded)]

Since P will cause deterioration in tenacity, due to segregation of P, occurring to grain boundaries, the lower P content is, the better. With the invention, the upper limit of P content is set to 0.025% from the viewpoint of ensuring the characteristics of the high-strength suspension spring. A preferable upper limit of P content is 0.020%, and a more preferable upper limit thereof is not more than 0.015%.

[S: not more than 0.025% (0% excluded)]

Since S causes brittleness at grain boundaries, and formation of coarse sulfides, thereby deterioration in tenacity, the lower S content is, the better. With the invention, the upper limit of S content is set to 0.025% from the viewpoint of ensuring the characteristics of the high-strength suspension spring. A preferable upper limit of S content is 0.020%, and a more preferable upper limit thereof is not more than 0.015%.

The basic composition of the steel wire rod according to the invention is as described in the foregoing, and balance comprises iron, and unavoidable impurities. The unavoidable impurities include, for example, elements unavoidably introduced into the steel wire rod depending on states of ferrous raw materials (scrap included), material such as secondary raw materials, and so forth, and states of production facilities and so forth, respectively. For example, Al, O, and N may be controlled so as to fall within the following ranges, respectively.

[Al: not more than 0.1%]

Since Al will promote decarburization, the lower Al content is, the better. The Al content is preferably set to not more than 0.1%. The Al content is more preferably set to not more than 0.05%, and still more preferably set to not more than 0.03%.

[O: not more than 0.0030%]

Since O will form coarse oxides, thereby bringing about deterioration in wire drawing workability, the lower O content is, the better. The O content is preferably set to not more than 0.003%, more preferably set to not more than 0.002%, and still more preferably set to not more than 0.0015%.

[N: not more than 0.006%]

If N exists in solid solution state, this will cause deterioration in wire drawing workability, and therefore, the lower N content is, the better. The N content is preferably set to not more than 0.006%, more preferably set to not more than 0.004%, and still more preferably set to not more than 0.003%.

Further, for the purpose of enhancement in other characteristics, the steel wire rod according to the invention may contain, for example, the following elements:

[Ti: 0.01%-0.10%]

Ti is an element for forming carbide and nitride, generating fine structures to thereby improve tenacity of the steel wire rod. Ti content is therefore preferably set to not less than 0.01%, and more preferably set to not less than 0.05%. However, if the Ti content is excessively high, this will render the carbide and nitride coarser, resulting in deterioration in tenacity. The Ti content is therefore preferably set to not more than 0.10%, and more preferably set to not more than 0.07%.

[V: 0.12%-0.30%]

V is an element for forming carbide and nitride, generating fine structures to thereby improve tenacity of the steel wire rod. V content is therefore preferably set to not less than 0.12%. However, if the V content is excessively high, this will render the carbide and nitride coarser, resulting in deterioration in tenacity. The V content is therefore preferably set to not more than 0.30%, and more preferably set to not more than 0.2%.

[Ni: 0.2-0.7%]

Ni is an element useful for enhancement in corrosion resistance, and Ni content is preferably set to not less than 0.2%. However, if the Ni content is excessively high, this will cause an increase in residual austenite, resulting in deterioration in spring characteristics. The upper limit of the Ni content is therefore preferably set to 0.7%, and more preferably set to 0.6%.

[Cu: not more than 1% (0% excluded)]

Cu is an element useful for enhancement in corrosion resistance, and in order to enable advantageous actions described as above to be effectively exhibited, Cu content is preferably set to not less than 0.1%, and more preferably set to not less than 0.2%. However, if the Cu content is excessively high, this will cause an increase in residual austenite, resulting in deterioration in the spring characteristics. The upper limit of the Cu content is therefore preferably set to 1%, more preferably set to 0.8%, and still more preferably set to 0.6%.

[Mo: not more than 1% (0% excluded)]

Mo is an element useful not only for ensuring strength, but also for increasing tenacity by lessening adverse effects such as deterioration in the tenacity, caused by the segregation of P, occurring to grain boundaries. In order to enable those effects described to be effectively exhibited, a preferable lower limit of Mo content is set to not less than 0.1%, and the lower limit thereof is more preferably set to not less than 0.2%. However, Mo is an element prone to solidification and segregation, and if the Mo content is excessively high, this will raise a risk of segregation regions being broken. Accordingly, a preferable upper limit of the Mo content is set to 1%. The upper limit of the Mo content is preferably set to 0.7%, and more preferably set to 0.5%.

[At Least One Element Selected from the Group Consisting of Nb: Not More Than 0.1% (0% Excluded), and Zr: Not More Than 0.1% (0% Excluded)]

Either Nb, or Zr is an element forming carbide and nitride, generating fine structures to thereby improve tenacity. Either those elements each may be singly added, or not less than two elements thereof may be used in combination with each other. In order to enable the advantageous actions described as above to be effectively exhibited, total content of Nb and Zr is preferably set to not less than 0.01%, and more preferably set to not less than 0.05%. However, if amounts of those elements are excessively large, this will render the carbide and nitride coarser, resulting in deterioration in the tenacity, so that Nb content and Zr content each are preferably set to not more than 0.1%, more preferably set to not more than 0.07%, and still more preferably set to not more than 0.05%.

Now, there is described a method for producing the spring steel wire rod described in the foregoing. The method according to the invention comprises the step of heating a spring steel (typically, the spring steel of the composition described in the foregoing) to a temperature (T1) not lower than 1110° C. at an average warming rate (HR1) not less than 15° C./min, and hot rolling the spring steel at a rolling temperature (T2) not lower than 850° C., and a finish-rolling temperature (T3) in a range of 900 to 1150° C. to be subsequently wound at a winding temperature (T4) in a range of 880 to 1050° C., and the step of cooling the spring steel after reaching the winding temperature (T4) at an average cooling rate (CR1) not less than 1.5° C./sec in a range of the winding temperature (T4) to 720° C., and at an average cooling rate (CR2) not more than 2° C./sec in a range of 720 to 600° C., so that cooling is executed at an average cooling rate (CR3) not more than 0.3° C./sec in a range of the winding temperature (T4) to 500° C.

The method according to the invention has a feature in that cooling conditions after winding, in particular, are finely controlled. More specifically, the feature of the invention lies in adoption of two-stage cooling of rapid cooling→slow cooling, whereby the average cooling rate (CR1) in the range of the winding temperature (T4) to 720° C. is increased to not less than 1.5° C./sec (quenching), and subsequently, the average cooling rate (CR2) in the range of 720 to 600° C. is slowed down to not more than 2° C./sec (slow cooling), as described in detail, on the precondition of controlling such that cooling is executed at the average cooling rate (CR3) not more than 0.3° C./sec throughout the range of from the winding temperature (T4) after winding to 500° C.

Thus, by finely controlling not only the average cooling rate (CR3) throughout the range of the winding temperature (T4) to 500° C. but also the respective average cooling rates (CR1, CR2) in the range of the winding temperature (T4) to 720° C. and the range of 720 to 600° C., it is possible to adjust the respective average grain sizes of the surface layer part, and the central part of the spring steel wire rod so as to fall within the respective ranges described in the foregoing, so that a spring excellent in both decarburization resistance, and wire drawing workability is finally obtained. As indicated by the working examples to be described later on, in the case of a wire rod wherein any of the average cooling rates (CR1, CR2, CR3) fails to meet the respective ranges according to the invention, desired characteristics cannot be obtained. Further, if respective conditions of the heating before the cooling, rolling, and winding do not meet respective requirements according to the invention, predetermined characteristics cannot be obtained either in spite of the cooling being executed as above (refer to the working examples to be described later on).

The method according to the invention is described hereinafter in order of the steps taken.

First, a billet of composition meeting the composition described in the foregoing is prepared to be heated to the temperature (T1) not lower than 1110° C. (T1) at an average warming rate (HR1) not less than 15° C./min.

The average warming rate (HR1) prior to the hot rolling, and the temperature (T1) for heating are important for inhibition of ferritic decarburization occurring at the time of hot rolling and quenching. If the average warming rate (HR1) is low, this will cause occurrence of a defective state such as occurrence of decarburization, and growth of coarse crystal grains in the central part, during heating. The average warming rate (HR1) is preferably at not less than 20° C./min, more preferably at not less than 25° C./min. Further, there is no particular limitation to the upper limit of the average warming rate (HR1) from the viewpoint of inhibiting decarburization, and generation of supercooled structures, however, the upper limit of the average warming rate (HR1) is preferably set to on the order of 50° C./min in consideration of surface melting, and so forth, due to an excessive increase in temperature.

Meanwhile, if the temperature (T1) for heating is low, the ferritic decarburization is prone to occur in the rolling process. Further, if T1 is low, this will cause the surface layer structure to become finer, so that the ferritic decarburization is prone to occur in the quenching process even though the ferritic decarburization has not occurred to a hot rolled steel wire rod. The temperature (T1) for heating is preferably at not lower than 1150° C., more preferably at not lower than 1200° C. Further, there is no particular limitation to the upper limit of the temperature (T1) for heating from the viewpoint of inhibiting the ferritic decarburization, however, the upper limit of the temperature (T1) for heating is preferably set to on the order of 1300° C. in consideration of an increase in surface layer flaw, and so forth, caused by an increase in scale. Furthermore, there is no particular limitation to heating-hold time at the temperature (T1) for heating provided that the heating-hold time meets a condition commonly adopted for production of a spring steel wire rod, and the heating-hold time is preferably controlled to, for example, a period of about 0 to one hour. Such a heating treatment described as above is preferably applied on the same line as a rolling line to be described later on.

Subsequently, hot rolling is carried out at the rolling temperature (T2) not lower than 850° C., and at the finish-rolling temperature (T3) in the range of 900 to 1150° C. in this case. In so doing, the ferritic decarburization otherwise occurring at the time of hot rolling and quenching can be inhibited.

First, the rolling temperature T2 (the lowest temperature during rolling) is set to not lower than 850° C. If the temperature T2 during the rolling is low, this will not only cause occurrence of the ferritic decarburization in the rolling process but also cause the surface layer structure of a rolled steel wire rod to become fine, so that the ferritic decarburization becomes prone to occur at the time of the quenching. The rolling temperature T2 is preferably at not lower than 900° C., and more preferably at not lower than 950° C. Further, there is no particular limitation to the upper limit of the rolling temperature T2 from the viewpoint of inhibiting the ferritic decarburization, however, the upper limit of the rolling temperature T2 is preferably set to on the order of 1100° C. in consideration of necessity of inhibiting coarsening of the central structure of the steel wire rod, and so forth.

The finish-rolling temperature T3 is controlled so as to fall in the range of 900 to 1150° C. T3 is an important parameter for controlling the structure of the hot rolled steel wire rod, and as indicated by the working examples to be described later on, if T3 is excessively high, this will turn austenite grains coarser to thereby turn the central structure as well coarser, so that the supercooled structures become prone to occur, thereby causing deterioration in the wire drawing workability. Furthermore, coarsening of the austenite will cause an increase in hardenability, and the supercooled structures become prone to occur, resulting in deterioration in the wire drawing workability. On the other hand, if T3 is excessively low, this will turn the austenite grains finer to thereby turn the surface layer structure as well finer, so that the ferritic decarburization occurs in the rolling process. With the invention, in consideration of those problems, the finish-rolling temperature T3 is set in the range described as above. T3 is preferably in a range of 900 to 1100° C., and more preferably in a range of 1000 to 1050° C.

Subsequently, winding is carried out at the winding temperature (T4) in the range of 880 to 1050° C. As with the case of the finish-rolling temperature T3 described as above, the winding temperature T4 as well is an important parameter for controlling the structure of the hot rolled steel wire rod, and if T4 is excessively high, this will cause coarsening of the central structure as well, due to coarsening of the austenite grains, thereby increasing hardenability, so that the supercooled structures become prone to occur, resulting in deterioration in the wire drawing workability (refer to the working examples to be described later on). On the other hand, if T4 is excessively low, this will cause the surface layer structure as well to be turned finer, due to the austenite grains being turned finer, so that the ferritic decarburization occurs in the quenching process. T4 is preferably in a range of 900 to 1000° C., and more preferably in a range of 920 to 950° C.

After the winding, cooling is executed. As described in the foregoing, with the invention, cooling (rapid cooling) is executed at the average cooling rate (CR1) not less than 1.5° C./sec in the range of the winding temperature (T4) to 720° C., and cooling (slow cooling) is executed at the average cooling rate (CR2) not more than 2° C./sec in the range of 720 to 600° C., such that the cooling is executed at the average cooling rate (CR3) not more than 0.3° C./sec throughout the range of from the winding temperature (T4) to 500° C. Thus, by executing fine controls in a temperature range (T4 to 600° C.) where ferrite-to-pearlite transformation takes place, as described in the foregoing, to thereby implement the two-stage cooling of rapid cooling→slow cooling, and by slowly cooling in all the steps after the winding, as described in the foregoing, inhibition of the ferritic decarburization at the time of the hot rolling and quenching can be rendered compatible with the enhancement of the wire drawing workability (refer to the working examples to be described later on).

Herein, the range of from the winding temperature T4 to 720° C. is a temperature range where the ferrite transformation does not take place, and upon temperature falling below 720° C., the ferrite transformation will take lace. With the invention, occurrence of the ferritic decarburization is prevented by cooling as rapidly as possible in a temperature range up to a temperature region (in the vicinity of 720° C.) where the ferrite transformation does not take place. Further, growth of the austenite grains, during cooling, is blocked by execution of rapid cooling described as above to thereby prevent coarsening of the central structure, and generation of the supercooled structures, attempting to attain enhancement in the wire drawing workability. The higher CR1 is, the better, and CR1 is preferably, for example, not less than 2° C./sec, and more preferably not less than 4° C./sec. Further, there is no particular limitation to the upper limit of CR1 from the viewpoint described as above, however, the upper limit of CR1 is preferably set to on the order of 70° C./sec for the purpose of avoiding occurrence of supercooling in the surface layer part.

Subsequently, the cooling (slow cooling) is executed at the average cooling rate (CR2) not more than 2° C./sec in the range of 720 to 600° C. If the slow cooling is executed at a temperature not higher than 720° C. as described, this will allow ferrite-pearlite transformation to sufficiently proceed, thereby lessening the generation of the supercooled structures, and enhancing the wire drawing workability. From the viewpoint described as above, the lower the average cooling rate CR2 in the range described as above is, the better. CR2 is preferably, for example, not more than 1.5° C./sec, and more preferably not more than 1.0° C./sec. Further, there is no particular limitation to the lower limit of CR2 from the viewpoint described as above, however, the lower limit of CR2 is preferably set to on the order of 0.5° C./sec in consideration of productivity, and so forth.

Furthermore, with the invention, the cooling is preferably executed at the average cooling rate on the order of not more than 0.3° C./sec throughout the range of from the winding temperature (T4) to about 500° C. By so doing, the generation of the supercooled structures can be inhibited. The lower the average cooling rate CR3 is, the better, and CR3 is preferably, for example, not more than 0.2° C./sec.

The spring steel wire rod according to the invention is for use in production of a suspension spring, valve spring, and so forth, and is suitably used as a wire rod for the suspension spring, in particular.

WORKING EXAMPLES

The invention will be more specifically described hereinafter with reference to working examples, however, it is to be pointed out that the invention be not limited to any of the following working examples and that the invention can be obviously carried out by making suitable changes and variations therein without departing from the spirit and scope thereof.

[Production of Wire Rods]

For the working examples, use was made of steel of composition commonly adopted in production of a spring steel wire rod, and characteristics of the working examples were examined by variously changing conditions of heat treatment applied thereto.

More specifically, steel wire rods (steel type Nos. 1 to 27) of various compositions shown in Table 1 were each produced in the form of an ingot to be processed into a billet of ϕ 155 mm, and subsequently, heating, hot rolling, winding, and cooling, under conditions described in Tables 2 to 4, respectively, were applied to the billet, having thereby produced hot rolled wire rods each in a range of 8.0 to 18 mm in wire diameter.

With reference to each of the hot rolled wire rods obtained as above, the average grain sizes Ds, Dc of the surface layer part, and the central part thereof, respectively, were measured by the method described previously, and evaluation on whether or not there exist ferritic decarburization, and supercooled structures, after rolling, was made by the following method. In this connection, at the time of evaluation being made on presence, and absence of the supercooled structures as well as the ferritic decarburization, in the rolled steel wire rod, no measurement was made on grain size of the rolled steel wire rod in which the ferritic decarburization, and the supercooled structures were found.

[Presence and Absence of the Supercooled Structures as Well as the Ferritic Decarburization, in the Hot Rolled Wire Rod]

The same specimens as were used in measurements of the average grain sizes Ds, Dc, respectively, were prepared. In this case, polishing was applied thereto such that observation faces correspond to the cross-sectional faces of the wire rod, respectively. Subsequently, the specimens each were etched with an ethanol solution of 2% nitric acid ("Nital" etchant) to thereby expose a metallic structure, and thereafter, observation was made in 4 visual fields of the specimen with the use of an optical microscope of 200× magnification, having thereby made the evaluation on the presence, and absence of the ferritic decarburization, and the presence, and absence of the supercooled structures (bainite, and martensite).

Further, with the use of the hot rolled wire rod obtained as above, wire drawing workability was evaluated by the following method.

[Wire Drawing Workability]

After the hot rolled wire rod was pickled to remove scales therefrom, surface coating by bonderizing was applied thereto, and subsequently, dry wire drawing at 20% reduction of area was executed, having thereby examined whether or not there existed a break in a drawn wire.

Subsequently, with reference to a drawn wire rod causing no break in the wire upon application of the wire drawing described as above, ferritic decarburization at the time of quenching, and spring characteristics were evaluated by the following method.

[Presence and Absence of Ferritic Decarburization at the Time of Quenching]

With Reference to the drawn wire rod obtained by application of the wire drawing described as above, there was executed quenching for holding the same at 930° C. in an electric furnace for 20 min→WQ. An average warming rate up to 930° C. was set to 10° C./s. With reference to the drawn wire after the quenching, there was made evaluation on presence and absence of the ferritic decarburization therein by the same method as that by which the evaluation was made on the presence and absence of the ferritic decarburization, in the hot-rolled steel wire rod.

[Spring Characteristics]

With reference to the drawn wire rod described as above, the quenching and tempering were applied thereto as follows, and subsequently, the drawn wire rod was processed into JIS testpieces (fatigue testpieces).

Quenching Condition:

20-minute holding at 930° C.→WQ (an average warming rate up to 930° C.: 10° C./s)

Tempering Condition:

60-minute holding at 430° C.→WC (an average warming rate up to 430° C.: 10° C./s)

An aqueous solution of 5% NaCl, at 35° C., was sprayed onto the respective testpieces, whereupon a rotating bending corrosion fatigue test under conditions of 784 MPa in stress, and 100 rpm in rotational speed was conducted thereon. Examination was made on whether or not a rupture occurred during the test repeated up to $1\times10^5$ times, thereby having evaluated spring characteristics.

Results of those tests are shown in Tables 3 to 4, respectively.

TABLE 1

| Steel type No. | mass % (balance: Fe and unavoidable impurities) | | | | | | | | | | | | |
|---|---|---|---|---|---|---|---|---|---|---|---|---|---|
| | C | Si | Mn | Cr | P | S | Ti | V | Ni | Cu | Mo | Nb | Zr |
| 1 | 0.05 | 3.21 | 0.09 | 2.51 | 0.032 | 0.008 | — | — | 1.00 | — | — | — | — |
| 2 | 0.21 | 0.04 | 0.21 | — | 0.010 | 0.009 | — | — | — | — | — | — | 0.020 |
| 3 | 0.40 | 1.70 | 0.12 | 1.10 | 0.012 | 0.010 | 0.068 | 0.195 | 0.50 | 0.21 | — | — | — |
| 4 | 0.57 | 1.38 | 0.70 | 0.62 | 0.015 | 0.020 | — | — | — | — | — | — | — |
| 5 | 0.20 | 0.05 | 0.21 | | 0.015 | 0.013 | | | | | | | |
| 6 | 0.35 | 3.21 | 0.20 | 1.98 | 0.007 | 0.008 | | | | | | | |
| 7 | 0.35 | 2.00 | 0.19 | 2.22 | 0.008 | 0.010 | | | | | | | |
| 8 | 0.35 | 1.91 | 0.98 | 0.23 | 0.021 | 0.025 | | | | | | 0.031 | |
| 9 | 0.37 | 2.23 | 0.82 | 0.21 | 0.025 | 0.003 | | | | | 0.98 | | |
| 10 | 0.39 | 1.75 | 0.10 | 1.08 | 0.008 | 0.006 | 0.062 | 0.175 | 0.49 | 0.19 | | | |
| 11 | 0.41 | 1.72 | 0.15 | 1.05 | 0.012 | 0.010 | | | | | | | 0.090 |
| 12 | 0.41 | 1.80 | 0.05 | 1.07 | 0.015 | 0.020 | | | 0.20 | | | | |
| 13 | 0.41 | 1.75 | 0.17 | 0.89 | 0.020 | 0.029 | | | | | | | |
| 14 | 0.42 | 1.75 | 0.17 | 1.20 | 0.013 | 0.017 | | 0.315 | 0.40 | 0.23 | | | |
| 15 | 0.43 | 1.95 | 0.23 | 1.88 | 0.008 | 0.007 | | | | | | 0.096 | |
| 16 | 0.47 | 2.10 | 0.79 | 0.18 | 0.017 | 0.016 | 0.096 | 0.153 | 0.30 | 0.28 | | | |
| 17 | 0.48 | 2.11 | 0.82 | 0.20 | 0.005 | 0.009 | | | 1.22 | | | | |
| 18 | 0.48 | 2.10 | 0.77 | 0.22 | 0.013 | 0.011 | | | | 1.51 | | | |
| 19 | 0.50 | 2.40 | 1.88 | 0.23 | 0.021 | 0.020 | | | | | | | |
| 20 | 0.50 | 2.40 | 0.88 | 0.20 | 0.008 | 0.009 | | | 0.31 | | 1.52 | | |
| 21 | 0.51 | 1.51 | 0.62 | 1.21 | 0.027 | 0.020 | | | | | | | |
| 22 | 0.61 | 2.01 | 0.90 | 0.13 | 0.015 | 0.019 | | | | | | | |
| 23 | 0.63 | 1.88 | 0.80 | 0.25 | 0.011 | 0.010 | | | | | | 0.186 | |
| 24 | 0.63 | 1.85 | 0.84 | 0.18 | 0.017 | 0.015 | 0.139 | | | | | | |
| 25 | 0.63 | 1.80 | 0.81 | 0.22 | 0.010 | 0.013 | | | | | | | 0.179 |
| 26 | 0.65 | 1.48 | 0.81 | 0.55 | 0.004 | 0.005 | | 0.290 | | | | | |
| 27 | 0.80 | 1.48 | 0.18 | 1.04 | 0.004 | 0.006 | | | | | | | |

TABLE 2

| Steel type No. shown in Table 1 | Steel wire rod No. | Warming rate (HR1) ° C./min | Heating temperature (T1) ° C. | The lowest rolling temperature (T2) ° C. | Finish-rolling temperature (T3) ° C. | Winding temperature (T4) ° C. | Average cooling rate (° C./sec) CR1 T4 to 720° C. | CR2 720 to 600° C. | CR3 T4 to 500° C. |
|---|---|---|---|---|---|---|---|---|---|
| 1 | 1-1 | 35 | 1280 | 980 | 1050 | 1050 | 2.0 | 0.8 | 0.3 |
| | 1-2 | 25 | 1200 | 980 | 1160 | 1070 | 1.5 | 2.0 | 0.3 |
| | 1-3 | 25 | 1150 | 940 | 1000 | 980 | 1.5 | 1.8 | 0.3 |
| | 1-4 | 25 | 1100 | 900 | 1100 | 900 | 5.2 | 1.5 | 0.3 |
| | 1-5 | 25 | 1050 | 900 | 1000 | 900 | 4.0 | 1.8 | 0.3 |
| | 1-6 | 10 | 1280 | 980 | 1050 | 1050 | 2.0 | 1.0 | 0.3 |
| 2 | 2-1 | 35 | 1280 | 1000 | 1100 | 1000 | 5.5 | 5.4 | 0.3 |
| | 2-2 | 20 | 1200 | 980 | 1170 | 1000 | 1.7 | 2.0 | 0.3 |
| | 2-3 | 15 | 1200 | 950 | 1080 | 950 | 1.5 | 0.5 | 0.2 |
| | 2-4 | 20 | 1200 | 900 | 900 | 900 | 8.1 | 0.7 | 0.3 |
| | 2-5 | 25 | 1100 | 800 | 1100 | 900 | 4.0 | 2.0 | 0.3 |
| 3 | 3-1 | 35 | 1280 | 980 | 1000 | 900 | 0.5 | 0.5 | 0.2 |
| | 3-2 | 25 | 1150 | 980 | 1000 | 980 | 2.4 | 1.0 | 0.3 |
| | 3-3 | 25 | 1150 | 980 | 1150 | 950 | 1.9 | 0.8 | 0.3 |
| | 3-4 | 25 | 1150 | 980 | 1000 | 980 | 1.2 | 0.5 | 0.2 |
| | 3-5 | 25 | 1100 | 850 | 1100 | 900 | 5.0 | 0.8 | 0.3 |
| | 3-6 | 25 | 1100 | 900 | 900 | 900 | 1.0 | 1.0 | 0.3 |
| | 3-7 | 25 | 1100 | 900 | 900 | 890 | 1.2 | 2.5 | 0.3 |
| | 3-8 | 10 | 1100 | 850 | 1100 | 900 | 4.2 | 1.1 | 0.3 |
| | 3-9 | 8 | 1100 | 850 | 1100 | 900 | 4.2 | 1.1 | 0.3 |
| | 3-10 | 5 | 1100 | 850 | 1100 | 900 | 5.0 | 1.5 | 0.3 |

| Steel type No. shown in Table 1 | Steel wire rod No. | Rolled steel wire rod: Ferritic decarburization | Rolled steel wire rod: Super-cooled structures | Grain size: Ds of a surface layer part μm | Grain size: Dc: Dc of the central part μm | Wire drawing workability | Ferritic decarburization in a quenched steel wire rod | Spring characteristics |
|---|---|---|---|---|---|---|---|---|
| 1 | 1-1 | none | none | 30.0 | 80.0 | ○ | ○ | X |
| | 1-2 | none | present | — | — | X | — | — |
| | 1-3 | none | none | 17.0 | 57.0 | ○ | ○ | X |
| | 1-4 | none | none | 13.0 | 42.0 | ○ | ○ | X |

TABLE 2-continued

| | | | | | | | | |
|---|---|---|---|---|---|---|---|---|
| | 1-5 | present | none | — | — | — | — | — |
| | 1-5 | none | none | 52.0 | 103.0 | X | — | — |
| 2 | 2-1 | none | present | — | — | X | — | — |
| | 2-2 | none | none | 29.0 | 93.0 | X | ○ | — |
| | 2-3 | none | none | 20.0 | 62.0 | ○ | ○ | X |
| | 2-4 | none | none | 12.0 | 37.0 | ○ | ○ | X |
| | 2-5 | present | none | — | — | — | — | — |
| 3 | 3-1 | present | none | — | — | — | — | — |
| | 3-2 | none | none | 16.0 | 52.0 | ○ | ○ | ○ |
| | 3-3 | none | none | 20.0 | 63.0 | ○ | ○ | ○ |
| | 3-4 | present | none | — | — | — | — | — |
| | 3-5 | none | none | 9.8 | 35.0 | ○ | ○ | ○ |
| | 3-6 | none | none | 19.0 | 84.0 | X | ○ | — |
| | 3-7 | present | present | — | — | X | — | — |
| | 3-8 | present | none | — | — | — | — | — |
| | 3-9 | present | none | — | — | — | — | — |
| | 3-10 | present | present | — | — | — | — | — |

TABLE 3

| Steel type No. shown in Table 1 | Steel wire rod No. | Warming rate (HR1) ° C./min | Heating temperature (T1) ° C. | The lowest rolling temperature (T2) ° C. | Finish-rolling temperature (T3) ° C. | Winding temperature (T4) ° C. | Average cooling rate (° C./sec) CR1 T4 to 720° C. | CR2 720 to 600° C. | CR3 T4 to 500° C. |
|---|---|---|---|---|---|---|---|---|---|
| 4 | 4-1 | 20 | 1200 | 1000 | 1000 | 880 | 7.5 | 1.2 | 0.3 |
| | 4-2 | 20 | 1200 | 880 | 880 | 880 | 7.8 | 1.2 | 0.3 |
| | 4-3 | 25 | 1150 | 1000 | 1000 | 800 | 3.2 | 1.0 | 0.3 |
| | 4-4 | 25 | 1150 | 1100 | 1100 | 920 | 1.3 | 2.4 | 0.3 |
| | 4-5 | 20 | 1100 | 850 | 900 | 900 | 10.5 | 1.5 | 0.3 |
| | 4-6 | 20 | 1100 | 870 | 900 | 850 | 10.0 | 1.1 | 0.3 |
| | 4-7 | 20 | 1100 | 870 | 900 | 900 | 0.2 | 0.2 | 0.2 |
| | 4-8 | 10 | 1100 | 850 | 900 | 900 | 5.4 | 0.7 | 0.3 |
| | 4-9 | 10 | 1200 | 1050 | 1100 | 920 | 7.2 | 1.2 | 0.3 |
| 5 | 5-1 | 25 | 1150 | 980 | 1000 | 980 | 2.4 | 1.0 | 0.3 |
| 6 | 6-1 | 25 | 1150 | 980 | 1000 | 980 | 2.4 | 1.0 | 0.3 |
| 7 | 7-1 | 25 | 1150 | 980 | 1000 | 980 | 2.4 | 1.0 | 0.3 |
| 8 | 8-1 | 25 | 1150 | 980 | 1000 | 980 | 2.4 | 1.0 | 0.3 |
| 9 | 9-1 | 25 | 1150 | 980 | 1000 | 980 | 2.4 | 1.0 | 0.3 |
| 10 | 10-1 | 25 | 1150 | 980 | 1000 | 980 | 2.4 | 1.0 | 0.3 |
| 11 | 11-1 | 25 | 1150 | 980 | 1000 | 980 | 2.4 | 1.0 | 0.3 |
| 12 | 12-1 | 25 | 1150 | 980 | 1000 | 980 | 2.4 | 1.0 | 0.3 |
| 13 | 13-1 | 25 | 1150 | 980 | 1000 | 980 | 2.4 | 1.0 | 0.3 |
| 14 | 14-1 | 25 | 1150 | 980 | 1000 | 980 | 2.4 | 1.0 | 0.3 |
| 15 | 15-1 | 25 | 1150 | 980 | 1000 | 980 | 2.4 | 1.0 | 0.3 |
| 16 | 16-1 | 25 | 1150 | 980 | 1000 | 980 | 2.4 | 1.0 | 0.3 |

| Steel type No. shown in Table 1 | Steel wire rod No. | Rolled steel wire rod: Ferritic decarburization | Rolled steel wire rod: Super-cooled structures | Grain size: Ds of a surface layer part μm | Grain size: Dc: Dc of the central part μm | Wire drawing workability | Ferritic decarburization in a quenched steel wire rod | Spring characteristics |
|---|---|---|---|---|---|---|---|---|
| 4 | 4-1 | none | none | 3.0 | 14.0 | ○ | ○ | ○ |
| | 4-1 | present | none | — | — | — | — | — |
| | 4-1 | present | none | — | — | — | — | — |
| | 4-1 | present | present | — | — | X | — | — |
| | 4-1 | none | none | 6.4 | 28.0 | ○ | ○ | ○ |
| | 4-1 | none | none | 2.7 | 15.0 | ○ | X | — |
| | 4-1 | present | none | — | — | — | — | — |
| | 4-1 | present | none | — | — | — | — | — |
| | 4-1 | none | present | — | — | X | — | — |
| 5 | 5-1 | none | none | 16.0 | 48.0 | ○ | ○ | X |
| 6 | 6-1 | present | none | 10.0 | 35.0 | ○ | ○ | ○ |
| 7 | 7-1 | none | none | 10.0 | 32.0 | ○ | ○ | X |
| 8 | 8-1 | none | none | 9.5 | 30.0 | ○ | ○ | ○ |
| 9 | 9-1 | none | none | 10.0 | 30.0 | ○ | ○ | ○ |
| 10 | 10-1 | none | none | 8.7 | 28.0 | ○ | ○ | ○ |
| 11 | 11-1 | none | none | 9.3 | 26.0 | ○ | ○ | ○ |
| 12 | 12-1 | none | none | 12.0 | 33.0 | ○ | ○ | X |
| 13 | 13-1 | none | none | 15.0 | 41.0 | ○ | ○ | X |
| 14 | 14-1 | none | none | 7.3 | 22.0 | ○ | ○ | X |

TABLE 3-continued

| | | | | | | | | |
|---|---|---|---|---|---|---|---|---|
| 15 | 15-1 | none | none | 6.5 | 18.0 | ○ | ○ | ○ |
| 16 | 16-1 | none | none | 8.2 | 27.0 | ○ | ○ | ○ |

TABLE 4

| Steel type No. shown in Table 1 | Steel wire rod No. | Warming rate (HR1) ° C./min | Heating temperature (T1) ° C. | The lowest rolling temperature (T2) ° C. | Finish-rolling temperature (T3) ° C. | Winding temperature (T4) ° C. | Average cooling rate (° C./sec) CR1 T4 to 720° C. | CR2 720 to 600° C. | CR3 T4 to 500° C. |
|---|---|---|---|---|---|---|---|---|---|
| 17 | 17-1 | 25 | 1150 | 980 | 1000 | 980 | 2.4 | 1.0 | 0.3 |
| 18 | 18-1 | 25 | 1150 | 980 | 1000 | 980 | 2.4 | 1.0 | 0.3 |
| 19 | 19-1 | 25 | 1150 | 980 | 1000 | 980 | 2.4 | 1.0 | 0.3 |
| 20 | 20-1 | 25 | 1150 | 980 | 1000 | 980 | 2.4 | 1.0 | 0.3 |
| 21 | 21-1 | 25 | 1150 | 980 | 1000 | 980 | 2.4 | 1.0 | 0.3 |
| 22 | 22-1 | 25 | 1150 | 980 | 1000 | 980 | 2.4 | 1.0 | 0.3 |
| 23 | 23-1 | 25 | 1150 | 980 | 1000 | 980 | 2.4 | 1.0 | 0.3 |
| 24 | 24-1 | 25 | 1150 | 980 | 1000 | 980 | 2.4 | 1.0 | 0.3 |
| 25 | 25-1 | 25 | 1150 | 980 | 1000 | 980 | 2.4 | 1.0 | 0.3 |
| 26 | 26-1 | 25 | 1150 | 980 | 1000 | 980 | 2.4 | 1.0 | 0.3 |
| 27 | 27-1 | 25 | 1150 | 980 | 1000 | 980 | 2.4 | 1.0 | 0.3 |

| Steel type No. shown in Table 1 | Steel wire rod No. | Rolled steel wire rod: Ferritic decarburization | Rolled steel wire rod: Super-cooled structures | Grain size: Ds of a surface layer part μm | Grain size: Dc: Dc of the central part μm | Wire drawing workability | Ferritic decarburization in a quenched steel wire rod | Spring characteristics |
|---|---|---|---|---|---|---|---|---|
| 17 | 17-1 | none | none | 12.0 | 34.0 | ○ | ○ | X |
| 18 | 18-1 | none | none | 11.0 | 30.0 | ○ | ○ | X |
| 19 | 19-1 | none | none | 15.0 | 39.0 | ○ | ○ | X |
| 20 | 20-1 | none | none | 14.0 | 36.0 | ○ | ○ | X |
| 21 | 21-1 | none | none | 17.0 | 45.0 | ○ | ○ | X |
| 22 | 22-1 | none | none | 13.0 | 37.0 | ○ | ○ | ○ |
| 23 | 23-1 | none | none | 6.2 | 15.0 | ○ | ○ | X |
| 24 | 24-1 | none | none | 6.0 | 14.0 | ○ | ○ | X |
| 25 | 25-1 | none | none | 7.3 | 14.0 | ○ | ○ | X |
| 26 | 26-1 | none | none | 7.7 | 19.0 | ○ | ○ | ○ |
| 27 | 27-1 | none | none | 13.0 | 38.0 | ○ | ○ | X |

Steel type Nos. 3, 4, 8 to 11, 15, 16, 22, and 26 among steel type Nos. 1 to 27, shown in Table 1, each were an example where requirements for composition of steel, as specified by the invention, were met. In contrast, the steel type No. 1 was an example where C content and Mn content were low, and content of Ni as an selectable element was high; the steel type No. 2 was an example where C content was low, and Cr was not contained; the steel type No. 5 was an example where C content and Si content were low, and Cr was not contained; the steel type No. 6 was an example where Si content was high; the steel type No. 7 was an example where Cr content was high; the steel type No. 12 was an example where Mn content was low; the steel type No. 13 was an example where S content was high; the steel type No. 19 was an example where Mn content was high; the steel type No. 21 was an example where P content was high; and the steel type No. 27 was an example where C content was high. Further, the steel type Nos. 14, 17, 18, 20, 23, 24, and 25 each were an example where an addition amount of any of elements, selected from the group consisting of V, Ni, Cu, Mo, Nb, Ti and Zr, was high, each of the elements being an selectable element.

First, examination is hereinafter made on steel wire rod Nos. 1-1 to 1-6, shown in Table 2, obtained by use of steel type No. 1 shown in Table 1, and by variously changing conditions of heat treatment applied thereto. Since the steel type No. 1 was low in the C content and Mn content, and high in the content of Ni as the selectable element, as previously described, the steel wire rod using the steel type No. 1 was found lacking in strength, and ductility tenacity (not shown in Table 2) for use as a spring steel wire rod, undergoing deterioration in spring characteristics as well. However, in order to demonstrate that even with this steel type, at least the decarburization and wire drawing workability can be enhanced provided that production conditions are adequately controlled, testing was conducted by changing the production conditions in the case of the present working example.

Any of the steel wire rod Nos. 1-1, 1-3, and 1-4, shown in Table 2, was the working example where the steel wire rod was produced under conditions meeting requirements of the invention, and was found excellent in both the decarburization and wire drawing workability.

In contrast, the steel wire rod No. 1-2, shown in Table 2, was the working example where the finish-rolling temperature T3, and the winding temperature T4 were too high, and the supercooled structures were generated in the rolled steel wire rod, resulting in a break in a drawn wire. Further, with the steel wire rod No. 1-5, shown in Table 2, since the heating temperature T1 was too low, decarburization occurred at the time of the hot rolling. With the steel wire rod No. 1-6, shown in Table 2, since the warming rate HR1 was too low, the average grain size Dc of the central part of the wire rod became larger, thereby causing a break in a drawn wire at the time of drawing.

Steel wire rod Nos. 2-1 to 2-5, shown in Table 2, each were the working example where use was made of the steel type No. 2 shown in Table 1, and conditions of heat treatment applied thereto were variously changed.

Any of the steel wire rod Nos. 2-2, 2-4, shown in Table 2, among those steel wire rods, was the working example where the steel wire rod was produced under conditions meeting the requirements of the invention. As previously described, with the steel type No. 2 shown in Table 1, the composition of the steel did not meet the requirements of the invention, so that the steel wire rod using the steel type No. 2 was found lacking in strength, and ductility tenacity (not shown in Table 2) for use as a spring steel wire rod, and undergoing deterioration in spring characteristics as well, however, because production conditions were adequately controlled, any of the steel wire rod Nos. 2-2, and 2-4 was found excellent in both the decarburization and wire drawing workability.

In contrast, the steel wire rod No. 2-1, shown in Table 2, was the working example where the average cooling rate CR2 in the range of 720 to 600° C. was too high, so that the supercooled structures were generated in the rolled steel wire rod, resulting in a break in a drawn wire. The steel wire rod No. 2-2, shown in Table 2, was the working example where the finish-rolling temperature T3 was too high, so that the average grain size Dc of the central part of the wire rod became larger, thereby causing a break in a drawn wire at the time of drawing. With the steel wire rod No. 2-5, shown in Table 2, since the rolling temperature T2 was too low, decarburization occurred at the time of the hot rolling.

Steel wire rod Nos. 3-1 to 3-10, shown in Table 2, each were the working example where use was made of the steel type No. 3 shown in Table 1, meeting the requirements for composition of steel, specified by the invention, and conditions of heat treatment applied thereto were variously changed.

Any of the steel wire rod Nos. 3-2, 3-3, and 3-5, shown in Table 2, among those steel wire rods, was the working example according to the invention, where the steel wire rod was produced under conditions meeting the requirements of the invention, and was found excellent in both the decarburization resistance, and wire drawing workability. Further, the steel wire rod Nos. 3-2, 3-3, and 3-5 each were found excellent in spring characteristics as well, and suitable for use as the spring steel wire rod.

In contrast, the steel wire rods No. 3-1, and 3-4, shown in Table 2, each were the working example where the average cooling rate CR1 in the range of the winding temperature T4 to 720° C. was too low, so that decarburization occurred at the time of the hot rolling. The steel wire rod No. 3-6, shown in Table 2, was the working example where the heat treatment conditions according to Patent Document 4 were simulated, and the average cooling rate CR1 in the range of the winding temperature T4 to 720° C. was low, so that the average grain size Dc of the central part of the wire rod became larger, although decarburization did not occur at the time of the hot rolling, thereby causing a break in a drawn wire at the time of drawing. The steel wire rod No. 3-7, shown in Table 2, was the working example where the average cooling rate CR1 in the range of the winding temperature T4 to 720° C. was low, and the average cooling rate CR2 in the range of 720 to 600° C. was high, so that there occurred decarburization and generation of supercooled structures at the time of the hot rolling. Any of the steel wire rod Nos. 3-8, 3-9, and 3-10, shown in Table 2, was the working example where the warming rate HR1 was too low, and decarburization occurred at the time of the hot rolling. Further, with the steel wire rod No. 3-10, shown in Table 2, generation of supercooled structures occurred during rolling.

Steel wire rod Nos. 4-1 to 4-9, shown in Table 3, each were the working example where use was made of the steel type No. 4 shown in Table 1, meeting the requirements for composition of steel, specified by the invention, and conditions of heat treatment applied thereto were variously changed.

Any of the steel wire rod Nos. 4-1, and 4-5, shown in Table 3, among those steel wire rods, was the working example according to the invention, where the steel wire rod was produced under conditions meeting the requirements of the invention, and was found excellent in both the decarburization resistance, and wire drawing workability. Further, the steel wire rod Nos. 4-1, and 4-5 each were found excellent in spring characteristics as well, and suitable for use as the spring steel wire rod.

In contrast, the steel wire rod No. 4-2, shown in Table 3, was the working example where the finish-rolling temperature T3 was low, and decarburization occurred at the time of the hot rolling. The steel wire rod No. 4-3, shown in Table 3, was the working example where the winding temperature T4 was too low, and decarburization occurred at the time of the hot rolling. The steel wire rod No. 4-4, shown in Table 3, was the working example where the average cooling rate CR1 in the range of the winding temperature T4 to 720° C. was too low, and the average cooling rate CR2 in the range of 720 to 600° C. was too high, so that there occurred decarburization and generation of supercooled structures at the time of the hot rolling. The steel wire rod No. 4-6, shown in Table 3, was the working example where the winding temperature T4 was low, and the average grain size Ds of the surface layer part of the wire rod was turned finer although decarburization did not occur at the time of the hot rolling, thereby causing occurrence of decarburization at the time of the quenching. The steel wire rod No. 4-7, shown in Table 3, was the working example where the average cooling rate CR1 in the range of the winding temperature T4 to 720° C. was too low, and decarburization occurred at the time of the hot rolling. Any of the steel wire rod Nos. 4-8, and 4-9, shown in Table 3, was the working example where the average warming rate HR1 was too low, and with the steel wire rod No. 4-8 of those steel wire rods, decarburization occurred at the time of the hot rolling. Further, with the steel wire rod No. 4-9, generation of supercooled structures occurred in the rolled steel wire rod, resulting in a break in a drawn wire.

Steel wire rod Nos. 5-1, 6-1, 7-1, 8-1, 9-1, 10-1, 11-1, 12-1, 13-1, 14-1, 15-1, 16-1, shown in Table 3, and Steel wire rod Nos. 17-1, 18-1, 19-1, 20-1, 21-1, 22-1, 23-1, 24-1, 25-1, 26-1, 27-1, shown in Table 4, each were the working example produced by use the steel type Nos. 5 to 27, shown in Table 1, respectively, composition of steel thereof being in respective ranges as specified by the invention (under the same production conditions). Any of those steel wire rods described as above was found excellent in both the decarburization resistance, and wire drawing workability.

Each of the steel wire rod Nos. 8-1, 9-1, 10-1, 11-1, 15-1, 16-1, shown in Table 3, and the steel wire rod Nos. 22-1, 26-1, shown in Table 4, among those steel wire rod, using the steel type meeting the requirements for composition of steel, as specified by the invention, was found excellent in spring characteristics as well, and suitable for use as the spring steel wire rod.

In contrast, with any of the steel wire rod Nos. 5-1, 6-1, 7-1, 12-1, 13-1, 14-1, shown in Table 3, and the steel wire rod Nos. 17-1, 18-1, 19-1, 20-1, 21-1, 23-1, 24-1, 25-1, 27-1, shown in Table 4, using the steel type failing to meet the requirements for composition of steel, as specified by the invention, spring characteristics were found deteriorated. Further, with the steel wire rod No. 6-1 using the steel type No. 6 having a high Si content, decarburization occurred at the time of the hot rolling.

What is claimed is:

1. A spring steel wire rod comprising:

Fe;

C in a range of 0.35 to 0.65% mass;

Si in a range of 1.4 to 2.2% mass;

Mn in a range of 0.10 to 1.0% mass;

Cr in a range of 0.1 to 2.0% mass;

P not more than 0.025% mass (0% excluded); and

S not more than 0.025% mass (0% excluded), wherein an average grain size Dc of a central part of the steel wire rod is more than 20 μm and not more than 80 μm, and an average grain size Ds of a surface layer part of the steel wire rod is not less than 3.0 μm and not more than 16.0 μm.

2. The spring steel wire rod of claim 1, further comprising:

Ti in a range of 0.01%-0.10% mass;

V in a range of 0.12%-0.30% mass;

Ni in a range of 0.2-0.7% mass; and

Cu not more than 1% mass (0% excluded).

3. The spring steel wire rod of claim 1, further comprising:

Mo not more than 1% mass (0% excluded).

4. The spring steel wire rod of claim 1, further comprising:

at least one element selected from the group consisting of

Nb not more than 0.1% mass (0% excluded), and

Zr not more than 0.1% mass (0% excluded).

5. The spring steel wire rod of claim 1, wherein the average grain size Ds of a surface layer part of the steel wire rod is not less than 5 μm.

6. The spring steel wire rod of claim 1, wherein the average grain size Ds of a surface layer part of the steel wire rod is not less than 7 μm.

7. The spring steel wire rod of claim 1, wherein the average grain size Ds of a surface layer part of the steel wire rod is not less than 10 μm.

8. The spring steel wire rod of claim 1, wherein the average grain size Ds of a surface layer part of the steel wire rod is not greater than 15 μm.

9. The spring steel wire rod of claim 1, wherein the average grain size Dc of a central part of the steel wire rod is not more than 60 μm.

10. The spring steel wire rod of claim 1, wherein the average grain size Dc of a central part of the steel wire rod is not more than 40 μm.

11. The spring steel wire rod of claim 1, wherein the average grain size Dc of a central part of the steel wire rod is not more than 30 μm.

12. The spring steel wire rod of claim 1, wherein C is comprised in a range of 0.40 to 0.65% mass.

13. The spring steel wire rod of claim 1, wherein C is comprised in a range of 0.35 to 0.60% mass.

14. The spring steel wire rod of claim 1, wherein C is comprised in a range of 0.35 to 0.49% mass.

15. The spring steel wire rod of claim 1, wherein C is comprised in a range of 0.40 to 0.60% mass.

16. The spring steel wire rod of claim 1, comprising greater than 0.40% mass C.

17. The spring steel wire rod of claim 1, wherein C is comprised in a range of 0.47 to 0.65% mass.

18. A method of producing the spring steel wire rod of claim 1, the method comprising:

heating a steel comprising, as mass percentages,

Fe,

C in a range of 0.35 to 0.65%,

Si in a range of 1.4 to 2.2%,

Mn in a range of 0.10 to 1.0%,

Cr in a range of 0.1 to 2.0%,

P not more than 0.025% (0% excluded), and

S not more than 0.025% (0% excluded), to a temperature (T1) not lower than 1110° C. at an average warming rate (HR1) not less than 15° C./min, and hot rolling the steel at a rolling temperature (T2) not lower than 850° C., and a finish-rolling temperature (T3) in a range of 900 to 1150° C. to be subsequently wound at a winding temperature (T4) in a range of 880 to 1050° C.; and cooling the steel after reaching the winding temperature (T4) at an average cooling rate (CR1) not less than 2.4° C./sec in a range of the winding temperature (T4) to 720° C., and at an average cooling rate (CR2) not more than 2° C./sec in a range of 720 to 600° C. such that cooling is executed at an average cooling rate (CR3) not more than 0.3° C./sec in a range of the winding temperature (T4) to 500° C.

* * * * *